United States Patent [19]

Saiki et al.

[11] Patent Number: 4,577,199

[45] Date of Patent: Mar. 18, 1986

[54] THERMAL TRANSFER RECORDING APPARATUS

[75] Inventors: Eisaku Saiki; Satoshi Kawamura, both of Yokohama; Masataka Kawauchi, Ishioka, all of Japan

[73] Assignee: Hitachi, Ltd., Tokyo, Japan

[21] Appl. No.: 612,809

[22] Filed: May 22, 1984

[30] Foreign Application Priority Data

May 23, 1983 [JP] Japan ..... 58-89129

[51] Int. Cl.[4] ..... B41J 35/10; B41J 3/20

[52] U.S. Cl. ..... 346/76 PH; 346/105; 400/120; 400/224.2; 400/240.3

[58] Field of Search ..... 400/218, 120, 224.1, 400/224.2, 234, 323, 614, 614.1, 621, 618, 240.3, 240.4; 346/76 R, 76 PH, 105, 136; 219/216 PH; 242/75.2

[56] References Cited

U.S. PATENT DOCUMENTS 4,250,511 2/1981 Stein et al. ..... 346/76 PH

FOREIGN PATENT DOCUMENTS 0086661 2/1983 European Pat. Off. ..... 346/76 PH

*Primary Examiner*—Harold Broome
*Assistant Examiner*—A. Evans
*Attorney, Agent, or Firm*—Antonelli, Terry & Wands

[57] ABSTRACT

In a thermal transfer recording system for use in a facsimile machine for a line-printer, a carrier such as a transfer film on which a heat transferable ink or any other record forming material is applied and a recording medium such as a recording paper are used. The carrier and the recording medium are wound in advance in a roll independently of each other. The carrier and the recording medium are brought into pressure contact with a thermal head in a recording section with the carrier and the recording medium overlapping one on another. Heat from the recording section causes the ink or any other record forming material on the carrier to be transferred onto the recording medium to thereby carry out the recording. The carrier and the recording medium may be conveyed in the normal direction or in the reverse direction. Upon the conveying the carrier and the recording medium in the normal or reverse direction, a predetermined constant tension is always applied to the carrier and the recording medium thereby preventing creases and strains from being generated in the carrier and the recording medium.

17 Claims, 8 Drawing Figures

THERMAL TRANSFER RECORDING APPARATUS

BACKGROUND OF THE INVENTION

The present invention relates to a thermal transfer recording apparatus, and, more particularly, to a thermal transfer recording apparatus for recording informations by using a wide strip-shaped carrier such as, for example, a transfer film to which a recording ink or any other record forming material is applied as in facsimiles or lineprinters.

In for example, U.S. Pat. No. 4,250,511, a thermal transfer recording apparatus is proposed wherein a carrier such as a transfer film to provided to which a recording ink or any other record forming material to be melted by heat is applied, and a recording medium such as a recording paper is laid on the carrier and moved together therewith. In a recording section, the ink or the like is melted by heating elements which constitute the recording section to transfer the ink to the recording medium.

In a thermal transfer recording apparatus of the aforementioned type, to obtain a quality image or a high resolution recording, it is necessary to move or feed the carrier such as transfer film and the recording medium together so that the recording paper has minimum crease or strain thereon.

More particularly, in order to achieve a high speed line-recording by using a wide carrier, as in facsimile machines or line-printers, it is very important to convey such a wide carrier without any crease or strain and, for this reason, in the facsimile machines or line-printers, by using a prewound carrier roll independent of the recording medium, the carrier and the recording medium overlap one on another and are fed together. In the recording section having a thermal head, the recording is achieved, and after the recording the carrier is wound on another roll and with the recording medium then being fed out of the recording apparatus.

A disadvantage of the above described construction, resides in the fact that, since the recording medium is fed out of the recording apparatus, a considerable amount of recording medium and carrier must be fed out in a non-recorded condition. For example, in a situation wherein the recorded medium is cut by a cutter and fed out of the recording apparatus after the recording, the recording medium is fed from the recorded section to the cutting section in the non-recorded condition, and, the carrier is wound on the reel in the non-recorded condition in correspondence with the feeding amount of the recording medium. Thus, portions of the carrier and the recording medium remain in a useless non-recorded condition.

To avoid this problem, it is possible to move a carrier and the recording medium in the reverse direction to a predetermined extent after a recording however, in the prior art apparatus, the feed forces applied to the carrier and the recording medium are different from each other so that creases and strains are inevitable.

An object of the present invention is to effectively utilize a carrier such as, for example, a transfer film and a recording medium such as, for example, a recording paper by conveying the carrier and the recording medium in the normal direction or feeding them in the reverse direction without any crease or strain generated in the carrier and the recording medium.

According to the present invention, a thermal transfer recording apparatus is provided wherein a carrier, such as a pre-rolled transfer film, independent of a recording medium, such as recording paper, includes a recording section, composed of rollers, and a thermal transfer recording apparatus which comprises means for imparting a normal/reverse rotational force to the recording section, feeding means for feeding at least the recording medium after the transfer recording, with the feeding means being provided downstream of the recording section. A mechanism is provided for winding-/rewinding the carrier separated from the recording medium after the transfer recording, and feeding means are provided for feeding the recording medium and the carrier in the normal/reverse direction without any crease or strain in the recording section.

DETAILED DESCRIPTION

Figure 1:
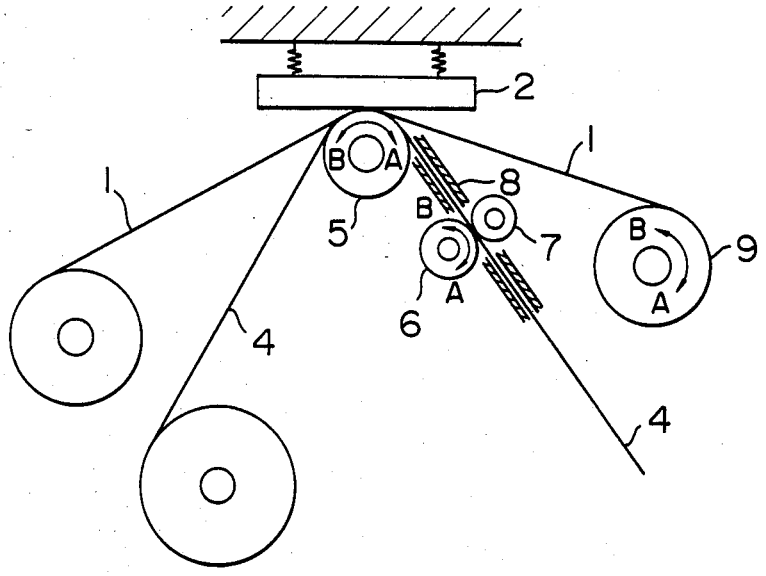
FIG. 1 is a schematic view showing a thermal transfer recording apparatus according to the present invention.

Referring now to the drawings wherein like reference numerals are used throughout the various views to designate like parts and, more particularly, to FIG. 1, according to this figure a thermal transfer recording apparatus according to the present invention includes a carrier, such as a transfer film 1, wound on a roll independently of a recording medium such as a recording paper 4. In a recording section, the transfer film 1 and the recording paper 4 overlap one on another and are brought into a pressing contact with a thermal head 2 by a platen roller 5, wherein the recording is carried out by the action of the thermal head 2.

For example, the transfer film 1 is constituted, as a base material, by a thin film which has a high heat resistive strength and a thickness of about 3 μm to 15 μm, with the film being, for example, a polyester film or a condenser paper. A heatmelting type or heat-sublimation type ink or any other record forming material which is kept in a solid phase at room temperature but may be brought into a transferable state such as a melting state or sublimating state by the application of heat thereto is applied to one-side surface of the transfer film 1. On the downstream side of the recording section, there are provided a conveying roller 6 for clamping and conveying the recording paper 4, a pressure roller 7 in contact with the conveying roller 6, guide members 8 for guiding the recording paper 4 and a take-up reel 9 for the transfer film 1 separated from the recording paper 4. The pressure roller 7 is drivingly connected to the conveying roller 6 through, for example, a gear train or a belt so as to be rotatable in a direction opposite to a rotational direction of the conveying roller 6. Also, a cutter member (not shown) for cutting a recorded part from the recording paper 4 is provided on a downstream side of the recording section.

The platen roller 5 is rotatable in either of the directions indicated by the arrows A, B. The conveying roller 6 and the takeup reel 9 for the transfer film 1 are rotatably supported so that the conveying roller 6 and the takeup reel 9 apply rotational torques at least in the direction of the arrow A.

The recording paper 4 and the transfer film 1, fed out from the reel independently of the recording paper 4, are supplied in a normal direction for sub-scanning by the rotational torques of the platen roller 5, the transfer roller 6 and the takeup reel 9 in the direction of the arrow A. The transfer film 1 and the recording paper 4 are processed in the recording section under the overlapping condition while being contacted with the thermal head 2 by the action of the platen roller 5.

Figure 2:
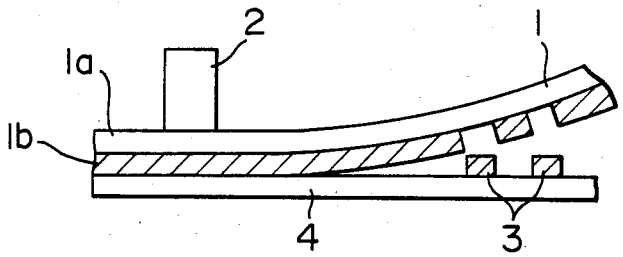
FIG. 2 is a cross-sectional view illustrating a recording mechanism in the thermal transfer recording apparatus.

As shown in FIG. 2, when heat is applied to the transfer film 1 by the thermal head 2, the heat propagates through the film 1*a* to an applied layer 1*b* of, for example, heat melting type ink or any other record forming material applied to a one-side surface of the film 1*a*. Thus, portions of the applied layer 1*b* corresponding to the thermal head 2, are melted into a liquid phase or a fluidized condition, and the molten parts are transferred onto the recording paper 4 when such process being repeated effect a recording on the recording paper 4.

After the heat thermal recording is carried out on the recording paper 4, the transfer film 1 and the recording paper 4 are separated from each other, and the transfer film 1 is taken up on the takeup reel 9. Also, the recording paper 4 passes through the guide members 8 and is conveyed to the outside of the apparatus while being clamped between the conveying roller 6 and the pressure roller 7.

The recorded parts of the recording paper 4 are cut by, for example, the cutter and are stacked on a stacker. After the recorded parts of the recording paper 4 are fed outside of the apparatus, a rotational torque in the direction the arrow B is applied to the platen roller 5, so that the transfer film 1 and the recording paper 4 are fed in the reverse direction by such a distance that, for example, the cut position of the recording paper 4 is returned to a vicinity of the thermal head 2 of the recording section. At this time, the takeup reel 9 for the transfer film 1 and the conveying roller 6 are rotated in the direction the arrow B while constant tensions are applied to the transfer film 1 and the recording paper 4 and are fed in the reverse direction.

Specific examples of drive means for the respective rollers and reels for use in the apparatus according to the present invention will be described referring to FIGS. 3 to 8.

Figure 3:
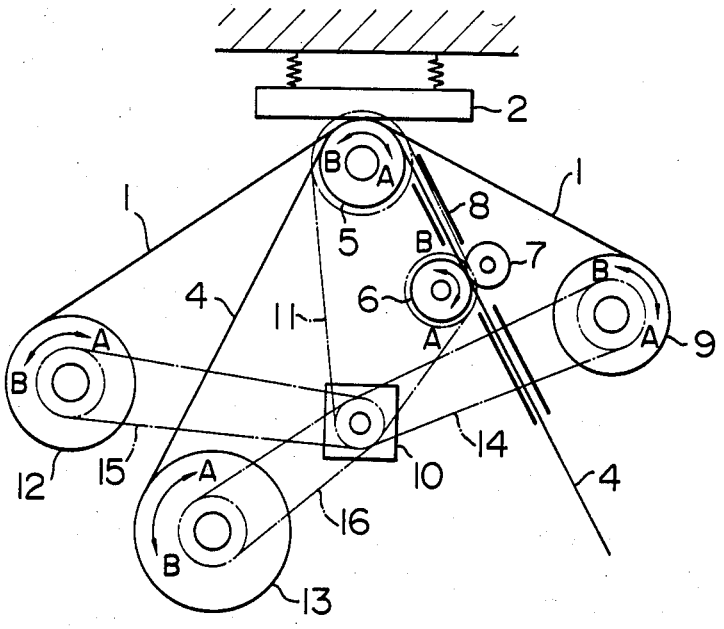
FIG. 3 is a partially schematic cross-sectional view of a thermal transfer recording apparatus constructed according to the invention.

In FIG. 3, the platen roller 5 and the conveying roller 6 are engaged with a pulse motor 10 by a drive transmission means such as a timing belt 11. Also, the takeup reel 9 for rewinding the transfer film 1 and reels 12, 13 on which the transfer film 1 and the roll of recording paper 4 are mounted are engaged with the pulse motor 10 by drive transmission means such as timing belts 14, 15 and 16, respectively. The platen roller 5 is rotated through the timing belt 11 in the direction of the arrow A (normal direction) or in the direction of the arrow B (reverse direction) by the normal or reverse rotation of the pulse motor 10.

For example, a one-way clutch and friction clutch mechanisms are interposed between the timing belts and shafts of the conveying roller 6, the takeup reel 9 and the reels 12,. When the transfer film 1 and the recording paper 4 are conveyed in the normal direction (upon the sub-scanning feed), the conveying roller 6 and the takeup reel 9 are subjected to rotational torques through the one-way clutch mechanism and the friction clutch mechanism from the pulse motor 10 and are rotated in the direction of the arrow A. On the other hand, the reels 12, 13 are not subjected to the rotational torques but are rotated in the A-direction in an idle rotating fashion. Also, when the transfer film 1 and the recording paper 4 are conveyed in the reverse direction in order to return the transfer film 1 and the recording paper 4 by a constant distance (upon reverse rotation), the reels 12, 13 are subjected to the rotational torques through the one-way clutch mechanisms and the friction clutch mechanisms from the pulse motor to be rotated in the direction of the arrow B, whereas, the conveying roller 6 and the takeup roller 9 are not subjected to the rotational torques but are rotated in the direction of the arrow B in an idle rotating manner.

Figure 4:
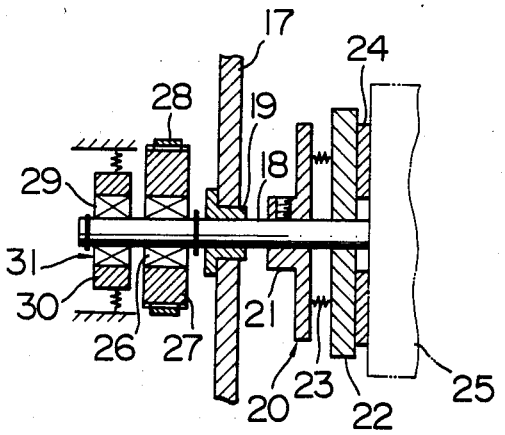
FIG. 4 is cross sectional view, on an enlarged scale, of a part of a rotary member having a one-way clutch mechanism and a friction clutch mechanism shown in FIG. 3.
Figure 5:
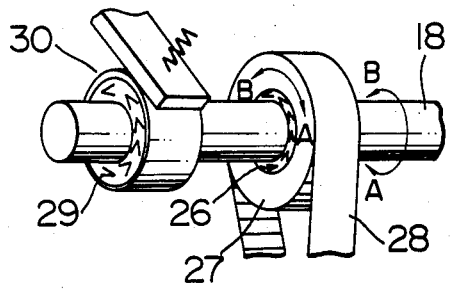
FIG. 5 is a perspective view of a detail of a part shown in FIG. 4.

FIGS. 4 and 5 show details of portions of the conveying roller 6, the takeup reel 9 and the reels 12, 13 which are rotary members each provided with a one-way clutch mechanisms and friction clutch mechanisms. A rotary shaft 18 is rotatably supported through a bearing 19 to a side plate 17. A friction clutch mechanism 20 is engaged with one end portion of the rotary shaft 18, with the friction clutch mechanism 20 comprising an adjustment ring 21 slidable in the axial direction of the rotary shaft 18 and mounted on the rotary shaft 18 so as to be fixed at any position to the rotary shaft 18, a ring 22 mounted on the rotary shaft 18 so as to be slidable in the axial direction of the rotary shaft 18, a compression spring 23 interposed between the rings 21 and 22, and a friction member 24 mounted on the backsurface of the ring 22. A rotary member 25, such as the conveying roller and the takeup reel, which comes into pressure contact with the friction clutch mechanism 20 through the friction member 24 of the friction clutch mechanism 20 is rotatably mounted on the rotary shaft 18. In the friction clutch mechanism 20, a frictional torque between the friction clutch mechanism 20 and the rotary member 25 may be freely set by moving the adjustment ring 21 in and axial direction. A timing pulley 27 is mounted on the other side of the rotary shaft 18 through a one-way clutch mechanism 26, with a timing belt 28 being entrained between the timing pulley 27 and the pulse motor (not shown). A brake mechanism 31, including a one-way clutch 29 and a brake shoe 30 pressed against a stationary side, are also mounted on the rotary shaft 18

Since the operation may be achieved in the same manner in a case that the rotary member 25 is selected from any one of the conveying roller 6, the takeup reel 9, and the reels 12, 13 shown in FIG. 3, except for the direction of the one-way clutch mechanism thereof, explanation will be made as to the case that the rotary member 25 is the takeup reel 9.

When the transfer film 1 and the recording paper 4 are conveyed in the normal direction (upon the subscanning feed), the rotational torque of the pulse motor 10 causes the timing pulley 27 to be rotated in the direction of the arrow A through the timing belt 14 (which corresponds to the timing belt 28 in FIGS. 4 and 5) and the rotary shaft 18 to be rotated in the direction of the arrow A through the one-way clutch mechanism 26. By the rotation of the rotary shaft 18 in the direction of the arrow A, the takeup reel 9 is rotated in the direction the arrow A through the friction clutch mechanism 20 which is set at a predetermined frictional torque.

No brake force is generated in the brake mechanism 31 by the action of the one-way clutch mechanism 29 thereof, and the rotary shaft 18 is allowed to rotate in an idle manner. A circumferential speed $V_3$ of the takeup reel 9 is varied in accordance with the amount of the wound transfer film 1. Therefore, the timing pulley 27 is selected so that the minimum winding circumferential speed $V_{3\,min}$ is greater than a circumferential speed $V_0$ of the platen roller 5.

Accordingly, when the rotary shaft 18 is rotated in the direction of the arrow A, the takeup reel 9 rewinds the transfer film 1 at the circumferential speed $V_3$. In this case, since the relation of $V_3 > V_0$ is established, a forward tension is applied to the transfer film 1. Since the frictional torque of the friction clutch mechanism 20 is suitably set so that when the forward tension applied to the transfer film 1 exceeds a predetermined value, a slippage will be generated between the friction member 24 thereof and the takeup reel 9, the transfer film 1 is wound on the takeup reel 9 under the condition that a constant forward tension is applied to the transfer film 1.

When the transfer film 1 and the recording paper 4 are fed in the reverse direction (upon the return feed), the rotational torque of the pulse motor 10 in the reverse direction causes the timing pulley 27 to be rotated in the direction of the arrow B through the timing belt 14 (which corresponds to the timing belt 28 shown in FIGS. 4 and 5). The rotation of the timing pulley 27 in the direction of the arrow B is not transmitted to the rotary shaft 18 due to the one-way clutch mechanism 26 and, consequently, the rotary shaft 18 is not rotated.

The reverse feed of the transfer film 1 and the recording paper 4 causes the takeup reel 9 to be rotated in the direction of the arrow B, and also the rotary shaft 18 would tend to be rotated in the direction of the arrow B. However, since on the rotary shaft 18, there is provided the brake mechanism 31 having the one-way clutch mechanism 29 and the brake shoe 30, a brake force will be generated to thereby prevent the rotary shaft 18 from rotating. Therefore, the rotation of the takeup reel 9 is absorbed by the friction clutch mechanism 20 and the transfer film 1 is fed with a predetermined back tension applied to the transfer film 1. The above-described operation is similarly applicable to the case of the conveying roller 6.

On the other hand, in the case of the reels 12, 13 on which the transfer film 1 and the recording paper 4 form are mounted, as described above, essentially the same construction as those of the takeup reel 9 for the transfer film 1 and the conveying roller 6 may be used but in that case, the direction of the one-way clutch mechanism is reversed. Namely, when the transfer film 1 and the recording paper 4 are conveyed in the normal direction, the timing pulley 27 is idled by the one-way clutch mechanism 26, its rotational torque is not transmitted to the reel 12 or 13, and the brake mechanism 30 will generate a brake force thereby braking the rotary shaft 18. Therefore, the transfer film 1 and the recording paper 4 are conveyed with a predetermined back tension applied to the transfer film 1 and the recording paper 4.

When the transfer film 1 and the recording paper 4 are fed in the reverse direction (upon the reverse or return feed), the rotational torque of the timing pulley 27 is transmitted through the rotary shaft 18 to the reel 12 or 13 by the one-way clutch 26 and no brake force will be generated in the brake mechanism 31. Therefore, the transfer film 1 and the recording paper 4 are fed in the reverse direction with a predetermined forward tension applied to the transfer film 1 and the recording paper 4.

As shown in FIG. 3, a single pulse motor 10 is used and a rotational torque therefrom is applied to the transfer film 1 and the recording paper 4 in the normal/-reverse direction while a tension is applied thereto. With such a construction, it is possible to convey the transfer film and the recording paper with a high reliability without creases and strains. The construction also enables a compact structure and low manufacturing cost.

Figure 6:
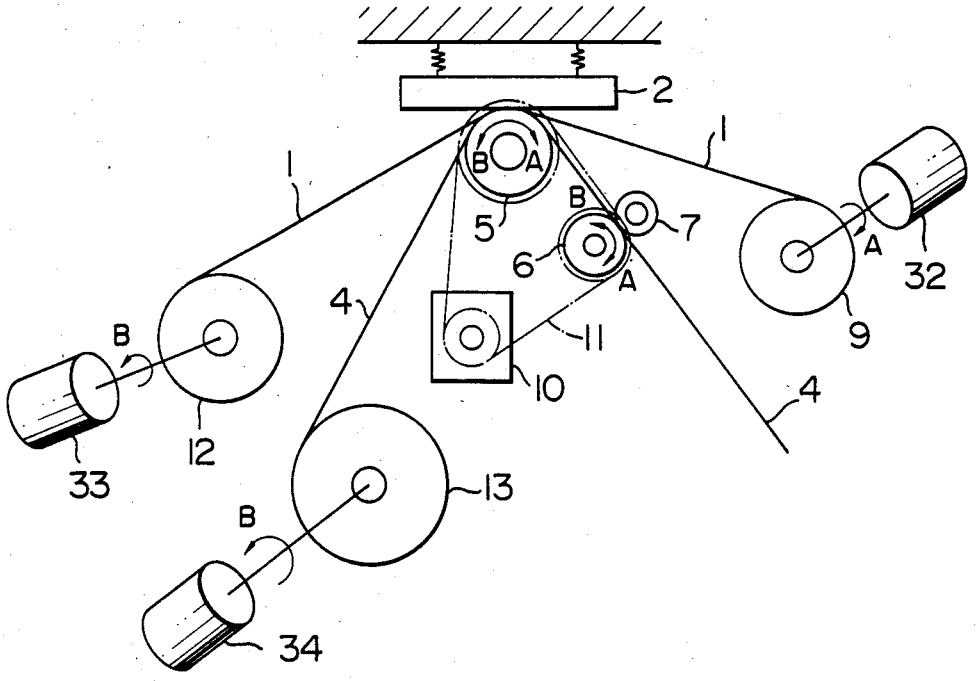
FIGS. 6, 7 and 8 are partial schematic views of other embodiments of a thermal transfer recording apparatus according to the present invention.

In FIG. 6, the platen roller 5 and the conveying roller 6 are engaged with a single pulse motor 10 through drive transmission means such as a timing belt 11. The normal rotation and the reverse rotation of the pulse motor 10 cause the platen roller 5 and the conveying roller 6 to be rotated in the direction of the arrow A and the direction of the arrow B, respectively, so that the overlapping transfer film 1 and the recording paper 4 are brought into contact with the thermal head 2 and are conveyed in the normal direction (sub-scanning feed) or in the reverse direction (return feed).

Also, a torque motor 32 provided with a friction clutch mechanism and rotated in the direction of the arrow A is connected to the take up reel 9. Torque motors 33, 34, each provided with friction clutch mechanisms and rotated in the direction of the arrow B are connected to the reels 12, 13. The rotational speeds of the respective torque motors 32, 33, 34 are set so that the circumferential speed $V_3$ of the takeup reel 9 and the circumferential speeds $V_1$, $V_2$ of the reels 12, 13 are greater than the circumferential speed $V_0$ of the platen roller 5. With such a construction, the transfer film 1 and the recording paper 4 are conveyed in the normal direction (upon the sub-scanning feed) or in the reverse direction (upon the return feed) so that a predetermined tension is applied to the transfer film 1 and the recording paper 4. This makes it easy to apply a suitable tension to the transfer film 1 and the recording paper 4. In particular, in case of transmission of a thin transfer film 1, creases and strains are prevented from generating with a high reliability in transmission.

Figure 7:
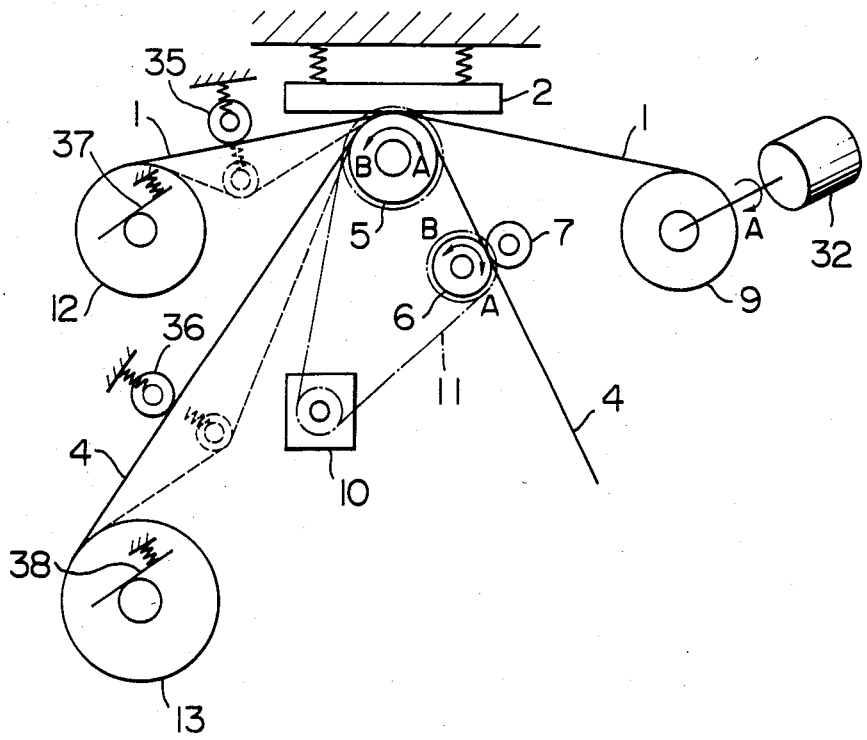

In FIG. 7, a single pulse motor 10 causes the platen roller 5 and the conveying roller 6 to be rotated in the direction of the arrow A and in the direction of the arrow B. The transfer film 1 and the recording paper 4 are overlapped and are brought into contact with the thermal head 2. The transfer film 1 and the recording paper 4 are fed in the normal direction or in the reverse direction. Also, a torque motor 32, rotated in the direction of the arrow A and provided with a friction clutch mechanism is connected to the takeup reel 9, with the speed of the torque motor 32 being set so that the circumferential speed $V_3$ of the takeup reel 9 is greater than the circumferential speed of the platen roller 5 a conveying roller 39 and pressure roller 40 are provided.

Any motor is not connected to the reel 12 or 13. Tension rollers 35, 36 are respectively disposed on the transfer film 1 betweeb the platen roller 5 and the reel 12 and on the recording paper 4 between the platen roller 5 and the reel 13, with the tension rollers 35 and 36 serving to absorb slackening of the transfer film 1 and the recording paper 4 in the reverse direction (upon the return feed). Also, brake mechanisms 37, 38 are respectively provided in the reels 12, 13 so that upon the normal feed (sub-scanning feed), a back tension is applied to the transfer film 1 and the recording paper 4 by the brake forces of the brake mechanisms 37 and 38. With such a construction, the transfer film 1 and the recording paper 4 are transferred in the normal direction or in the reverse direction so that a predetermined tension is applied to the transfer film 1 and the recording paper 4.

Figure 8:
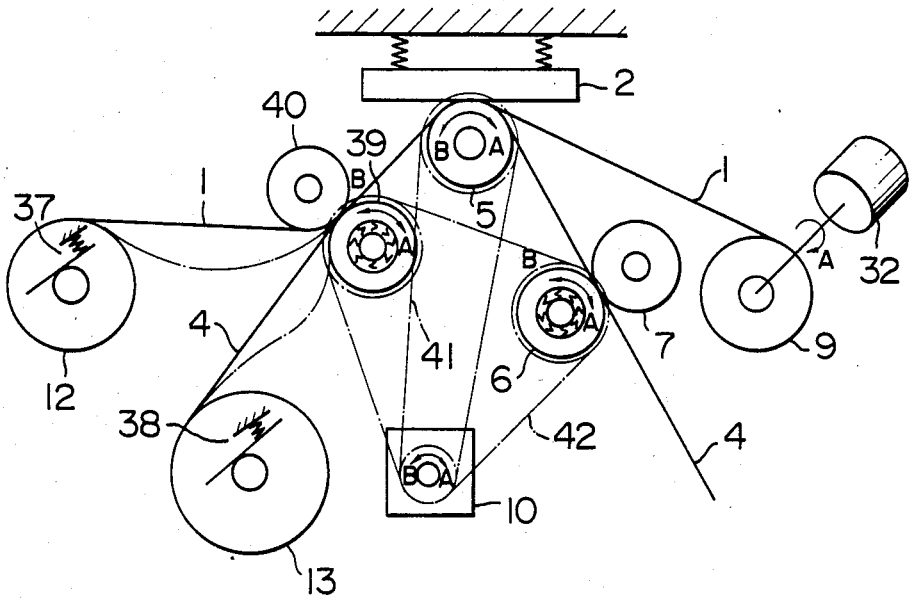

In FIG. 8, instead of the tension rollers 35 and 36 shown in FIG. 7, a conveying roller 39 and pressure roller 40 are provided on the transfer film 1 and the recording paper 4 between the platen roller 5 and the reels 12, 13, with the conveying roller 39 and pressure roller 40 being rotated in the opposite direction to that of the conveying roller and coupled through, for example, a gearing to the conveying roller 39, so that the transfer film 1 and the recording paper 4 are clamped therebetween. The platen roller 5 is engaged with the pulse motor 10 through a timing belt 41, and the conveying roller 6 and the conveying roller 39 are engaged with the pulse motor 10 through a timing belt 42. In the same manner as in the conveying roller 6, the conveying roller 39 incorporates, between the shaft thereof and the timing belt, a one way clutch mechanism and a friction clutch mechanism having a directionability opposite to that of the conveying roller 6. When such a construction, in the same manner as in the preceding example, the transfer film 1 and the recording paper 4 are conveyed in the normal direction that so predetermined forward and back tensions are applied to the transfer film 1 and the recording paper 4.

Also, when the transfer film 1 and the recording paper 4 are conveyed in the reverse direction, the transfer film 1 and the recording paper 4 are subjected to a forward tension by the platen roller 5 and the conveying roller 39 and are conveyed so that the transfer film 1 and the recording paper 4 are subjected to a back tension by the friction clutch mechanism of the conveying roller 6 and the friction clutch mechanism of the torque motor 32. The transfer film 1 and the recording paper 4 fed in the reverse direction are not rewound on the reels 12 and 13 but are brought into a slack state as indicated by dot-and-chain lines in FIG. 8 between the conveying roller 39 and the reels 12, 13, respectively.

With such a construction, either in the normal feed or in the reverse feed, creases and strains are prevented from generating with a high reliability in conveyance, thereby making the apparatus compact in size and low in manufacturing cost.

In the foregoing examples, the separation of the transfer film 1 and the recording paper 4 on which a recording process is carried out is attained by winding the transfer film 1 on the takeup reel 9 and conveying the recording paper with the conveying roller 6 while applying forward tensions to the transfer film 1 and the recording paper 4 without any separating means. However, instead thereof, it is possible to separate the transfer film 1 and the recording paper 4 by providing a guide roller between the recording section and the conveying roller 6 so that the conveying directions of the transfer film 1 and the recording paper 4 are different from each other at that location. In addition, it is possible to provide a separating member for positively separating the film and the paper. With such a construction, a separation between the transfer film 1 and the recording paper 4 is further ensured.

Also, drive sources for rotating the respective rollers and the reels are not limited to a pulse motor or a torque motor and any other means having equivalent functions may be employed.

As described above, in accordance with the present invention, the carrier and the recording medium may be fed in either normal direction or reverse direction without any crease or strain in the carrier and the recording medium so that the recording medium and the transfer film may be effectively utilized.

What is claimed is:

1. A thermal transfer recording apparatus comprising a carrier having a record forming material on its surface, a recording medium, a thermal head having heating elements, and a recording section including means for pressing said carrier and said recording medium against each other; carrier mounting means and recording medium mounting means for mounting said carrier and said recording medium independently of each other on an upstream side of said recording section; carrier mounting means for mounting said carrier on a downstream side of said recording section; conveying means for conveying said recording medium on the downstream side of said recording section; a conveying mechanism capable of conveying said carrier and said recording medium in a normal direction and in a reverse direction; and means for applying tension to the carrier and the recording medium upon feeding said carrier and said recording medium in said normal direction and in said reverse direction, said tension applying means being provided on the upstream and downstream sides of said recording section.

2.

A thermal transfer recording apparatus as claimed in claim 1, wherein said converying mechanism includes a reversible drive source connected to said pressing means of said recording section, and the tension applying means are connected to said upstream carrier mounting means, said upstream recording medium mounting means, said downstream carrier mounting means and said downstream recording medium conveying means, said reversible drive source is connected through said tension applying means to said upstream carrier mounting means, said upstream recording medium mounting means, said downstream carrier mounting means and said dewnstream recording medium conveying means.

3. A thermal transfer recording apparatus as claimed in claim 1 wherein said tension applying means are connected to said upstream carrier mounting means, said upstream recording medium mounting means, said downstream carrier mounting means and said downstream recording medium conveying means, and wherein said conveying mechanism includes a reversible drive source connected through said tension applying means to said upstream carrier mounting means, said upstream recording medium mounting means, said downstream carrier mounting means and said downstream recording medium conveying means.

4. A thermal transfer recording apparatus as claimed in claim 3, wherein said tension applying means includes a friction clutch mechanism, a one-way clutch mechanism and a brake mechanism, said reversible drive source being connected to said one-way clutch mechanism of said tension applying mechanism.

5. A thermal transfer recording apparatus as claimed in claim 1, wherein said tension applying means are connected to said upstream carrier mounting means, said upstream recording medium mounting means and said downstream carrier mounting means, and one-way rotatable drive source connected to said upstream carrier mounting means, said upstream recording medium mounting means and said downstream carrier mounting means, said conveying mechanism includes a reversible drive source connected through said tension applying means to said downstream recording medium conveying means.

6. A thermal transfer recording apparatus as claimed in claim 5, wherein the one-way rotatable drive includes a friction clutch mechanism connected to said upstream carrier mounting means, said upstream recording medium mounting means and said downstream carrier mounting means, the tension applying means connected to said downstream recording medium conveying means includes a friction clutch mechanism, a one-way clutch mechanism and a brake mechanism, with said reversible drive source being connected through said one-way clutch mechanism to said downstream recording medium conveying means.

7. A thermal transfer recording apparatus as claimed in claim 1, wherein said conveying mechanism includes a reversible drive source connected to said pressing means of said recording section, brake mechanisms are connected to said upstream carrier mounting means and said upstream recording mounting means, said tension applying means for applying tension to said carrier and said recording medium are disposed on said upstream side together with said brake mechanism, and a drive source is connected through said tension applying means to said downstream carrier mounting means.

8. A thermal transfer recording apparatus as claimed in claim 7, wherein the drive source connected to said downstream carrier mounting means is a one-way rotatable drive source connected through the tension applying means having a friction clutch mechanism to said downstream carrier mounting means, the tension applying means having a friction clutch mechanism, a one-way clutch mechanism, and a brake mechanism is connected to said downstream recording medium conveying means and a reversible drive source is connected through said one-way clutch mechanism to said downstream recording medium conveying means.

9. A thermal transfer recording apparatus as claimed in claim 7 or 8, wherein said tension applying means for applying tension to said carrier and said recording medium includes tensioning members engaging with said carrier and said recording medium on the upstream side of said recording section.

10. A thermal transfer recording apparatus as claimed in claim 7 or 8, wherein said tension applying means for applying tension to said carrier and said recording medium includes a conveying roller and a pressure roller by which said carrier and said recording medium are clamped, on the upstream side of said recording section.

11. A thermal transfer recording apparatus comprising a carrier having a record forming material on its surface and wound in a roll form, a recording medium wound in a roll form independently of said carrier, a thermal head having heating elements and a recording section including a roller for pressing said carrier and said recording medium laid on said carrier; a carrier and recording medium mounting reels on which said carrier and said recording medium are mounted independently of each other; a carrier winding reel for winding thereon said carrier downstream of said recording section; a conveying roller and a pressure roller for conveying and clamping said recording medium downstream of said recording section; a conveying mechanism capable of conveying said carrier and said recording medium in a normal direction and in a reverse direction; and tension applying means for applying tension to said carrier and said recording medium upon feeding said carrier and said recording medium in said normal direction and in said reverse direction, said tension applying means being provided on the upstream and downstream sides of said recording section.

12. A thermal transfer recording apparatus as claimed in claim 11, wherein said conveying mechanism includes a reversible drive source is connected to said roller of said recording section, said tension applying means is connected to said carrier mounting reel, said recording medium mounting reel, said carrier winding reel and said recording medium conveying roller, and a drive source is connected through said tension applying means to said carrier mounting reel, said recording medium mounting reel, said carrier winding reel and said recording medium conveying roller.

13. A thermal transfer recording apparatus as claimed in claim 12, wherein the tension applying means includes a friction clutch mechanism, a one-way clutch mechanism and a brake mechanism is connected to said carrier mounting reel, said recording medium mounting reel, said carrier winding reel and said recording medium conveying roller and the reversible drive source is connected through said one-way clutch mechanism of said tension applying means to said carrier mounting reel, said recording medium mounting reel, said carrier winding reel and said recording medium conveying roller.

14. A thermal transfer recording apparatus as claimed in claim 11, wherein the tension applying means includes a friction clutch mechanism connected to said carrier mounting reel, said recording medium mounting reel and said carrier winding reel, a one-way rotatable drive is connected through said friction clutch mechanism to said carrier mounting reel, said recording medium mounting reel and said carrier winding reel, the tension applying means having a friction clutch mechanism, a one-way clutch mechanism and a brake mechanism is connected to said recording medium conveying roller, and the conveying mechanism includes a reversible drive source connected through the one-way clutch of said tension applying means to said recording medium conveying roller.

15. A thermal transfer recording apparatus as claimed in claim 11, wherein the conveying mechanism includes a reversible drive source connected to the roller of said recording section, a brake mechanism is connected to said carrier mounting reel and the recording medium mounting reel, the tension applying means for applying tension to said carrier and said recording medium is disposed together with said brake mechanism upstream of said recording section, and the reversible drive source is connected through said tension applying means to said carrier winding reel and said recording medium conveying roller.

16. A thermal transfer recording apparatus as claimed in claim 11, wherein said tension applying means for applying tension to said carrier and said recording medium includes tensioning members engaging with said carrier and said recording medium upstream of said recording section, a one-way rotatable drive is connected through said tension applying means having a friction clutch mechanism to said carrier winding reel, the tension applying means having a friction clutch mechanism, a one-way clutch mechanism and a brake mechanism is connected to said recording medium conveying roller, and the converying mechanism includes a reversible drive source connected through said one-way clutch mechanism to said recording medium conveying roller.

17. A thermal transfer recording apparatus as claimed in claim 15, wherein a oneway rotatable drive is connected through the tension applying means having a friction clutch mechanism to said carrier winding reel, a friction clutch, a one-way clutch mechanism and a brake mechanism is connected to said recording medium conveying roller, and the reversible drive source is connected through said one-way clutch mechanism to said recording medium conveying roller.

* * * * *